US009828992B2

(12) United States Patent
Stambaugh, Sr.

(10) Patent No.: US 9,828,992 B2
(45) Date of Patent: Nov. 28, 2017

(54) VANE PUMPS WITH VANE WEAR DETECTION

(71) Applicant: Hamilton Sundstrand Corporation, Charlotte, NC (US)

(72) Inventor: Craig T. Stambaugh, Sr., Tolland, CT (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 250 days.

(21) Appl. No.: 14/795,338

(22) Filed: Jul. 9, 2015

(65) Prior Publication Data

US 2017/0009768 A1 Jan. 12, 2017

(51) Int. Cl.

| | |
|---|---|
| ***F04C 2/344*** | (2006.01) |
| ***F04C 18/344*** | (2006.01) |
| ***F01C 21/08*** | (2006.01) |
| ***F04C 28/28*** | (2006.01) |
| ***F04C 14/28*** | (2006.01) |

(52) U.S. Cl.

CPC ..... *F04C 14/28* (2013.01); *F01C 21/0809* (2013.01); *F04C 2/3448* (2013.01); *F04C 18/3442* (2013.01); *F04C 18/3448* (2013.01); *F04C 28/28* (2013.01); *F04C 2220/40* (2013.01); *F04C 2270/86* (2013.01)

(58) Field of Classification Search

CPC ... F01C 21/0809; F04C 28/28; F04C 2270/86
See application file for complete search history.

(56) References Cited

U.S. PATENT DOCUMENTS

| | | | | |
|---|---|---|---|---|
| 3,463,384 | A * | 8/1969 | Kilbane | F04C 28/28 417/63 |
| 6,752,604 | B2 * | 6/2004 | Althouse | F01C 21/0809 418/2 |
| 6,913,451 | B2 * | 7/2005 | Hedrick | F01C 21/0809 418/2 |
| 7,207,785 | B2 | 4/2007 | Dalton et al. | |
| 8,564,449 | B2 * | 10/2013 | Mitchell | F04C 14/00 340/454 |
| 8,800,360 | B2 | 8/2014 | Itoh et al. | |
| 2002/0110467 | A1 | 8/2002 | Henderson | |
| 2004/0136852 | A1 * | 7/2004 | Hedrick | F01C 21/0809 418/2 |

FOREIGN PATENT DOCUMENTS

EP 851127 A2 7/1998

OTHER PUBLICATIONS

European Search Report dated Sep. 13, 2016 by the European Patent Office, in corresponding European Patent Application No. EP16178593.6.

* cited by examiner

*Primary Examiner* — Mary A Davis
(74) *Attorney, Agent, or Firm* — Locke Lord LLP; Joshua L. Jones; Daniel J. Fiorello

(57) ABSTRACT

A vane pump includes a liner defining a cammed inner surface, a rotor rotatably disposed within the liner that has a plurality of vane slots, and a plurality of vanes slidably disposed within vane slots of the rotor and configured to extend away from the rotor and contact the cammed inner surface of the liner. The plurality of vanes include at least one sentinel vane that is configured to allow detection of wear on the sentinel vane.

11 Claims, 4 Drawing Sheets

VANE PUMPS WITH VANE WEAR DETECTION

STATEMENT OF GOVERNMENT RIGHTS

This invention was made with government support under contract no. N00019-02-C-3003 awarded by the Joint Program Office (JPO). The government has certain rights in the invention.

BACKGROUND

1. Field

The present disclosure relates to pump systems, more specifically to vane pumps.

2. Description of Related Art

A common failure mode of vane pumps is the wear and fracture of the rotating vanes. Traditionally, unlike other positive displacement pumps such as gear-type pumps, wear is virtually impossible to detect since flow performance is not degraded until a vane fracture occurs. A vane fracture can quickly cascade to remaining vanes resulting in sudden loss of pump function without warning.

Such conventional methods and systems have generally been considered satisfactory for their intended purpose. However, there is still a need in the art for improved vane pump systems with wear detection. The present disclosure provides a solution for this need.

SUMMARY

In accordance with at least one aspect of this disclosure, a vane pump includes a liner defining a cammed inner surface, a rotor rotatably disposed within the liner that has a plurality of vane slots, and a plurality of vanes slidably disposed within vane slots of the rotor and configured to extend away from the rotor and contact the cammed inner surface of the liner. The plurality of vanes include at least one sentinel vane that is configured to allow detection of wear on the sentinel vane.

The sentinel vane can include a base portion that is larger than the vane slot of the rotor such that after the sentinel vane wears a predetermined amount, the base portion prevents the sentinel vane from extending further from the rotor such that a gap separates a sentinel vane tip and a portion of the cammed inner surface. The portion of the cammed inner surface can include a constant radius section.

The rotor can include a plurality of symmetrically located sentinel vanes. The plurality of symmetrically located sentinel vanes can include two sentinel vanes spaced 180 degrees circumferentially from each other. In certain embodiments, the plurality of symmetrically located sentinel vanes can be spaced circumferentially apart 360/N degrees, wherein N is the total number of sentinel vanes.

The vane pump can further include a vibration sensor operatively connected to the rotor to determine when the base portion of the at least one sentinel vane contacts the rotor. In certain embodiments, the vane pump can further include a sensor operatively connected to the vane pump to sense a pressure pulsation from flow through the gap created between the sentinel van tip and the liner. The vane pump can further include a sensor that is operatively connected to the vane pump and/or at least one device that is connected to the vane pump to sense a pressure or flow loss due to the gap.

In accordance with at least one aspect of this disclosure, a method for detecting wear in a vane pump can include allowing a gap to form between a sentinel vane tip and a liner in at least one section of the liner as the sentinel vane passes through the at least one section. Allowing the gap to form can include restraining a base portion of the sentinel vane within the rotor by allowing the base portion to contact the rotor to prevent further outward movement of the sentinel vane.

The method can further include detecting a vibration due to the base portion of the sentinel vane contacting the rotor. In certain embodiments, the method can include detecting a pressure pulsation due to flow through the gap between the sentinel vane tip and the liner. The method can include determining a performance loss of the vane pump due to the gap between the sentinel vane tip and the liner. The method can further comprising indicating that the vane pump is in a worn condition.

In accordance with at least one aspect of this disclosure, a sentinel vane for a vane pump can include a body configured to slide within a vane slot of a rotor. The body can define a tip and a base portion, wherein the base portion is wider than a remaining portion of the body to allow the vane to slide radially outward through the vane slot up to the base portion.

The base portion can be shaped to have a corresponding contour of an undervane cavity surface. For example, the base portion can be curved or have any other suitable shape.

These and other features of the systems and methods of the subject disclosure will become more readily apparent to those skilled in the art from the following detailed description taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION

Figure 1:
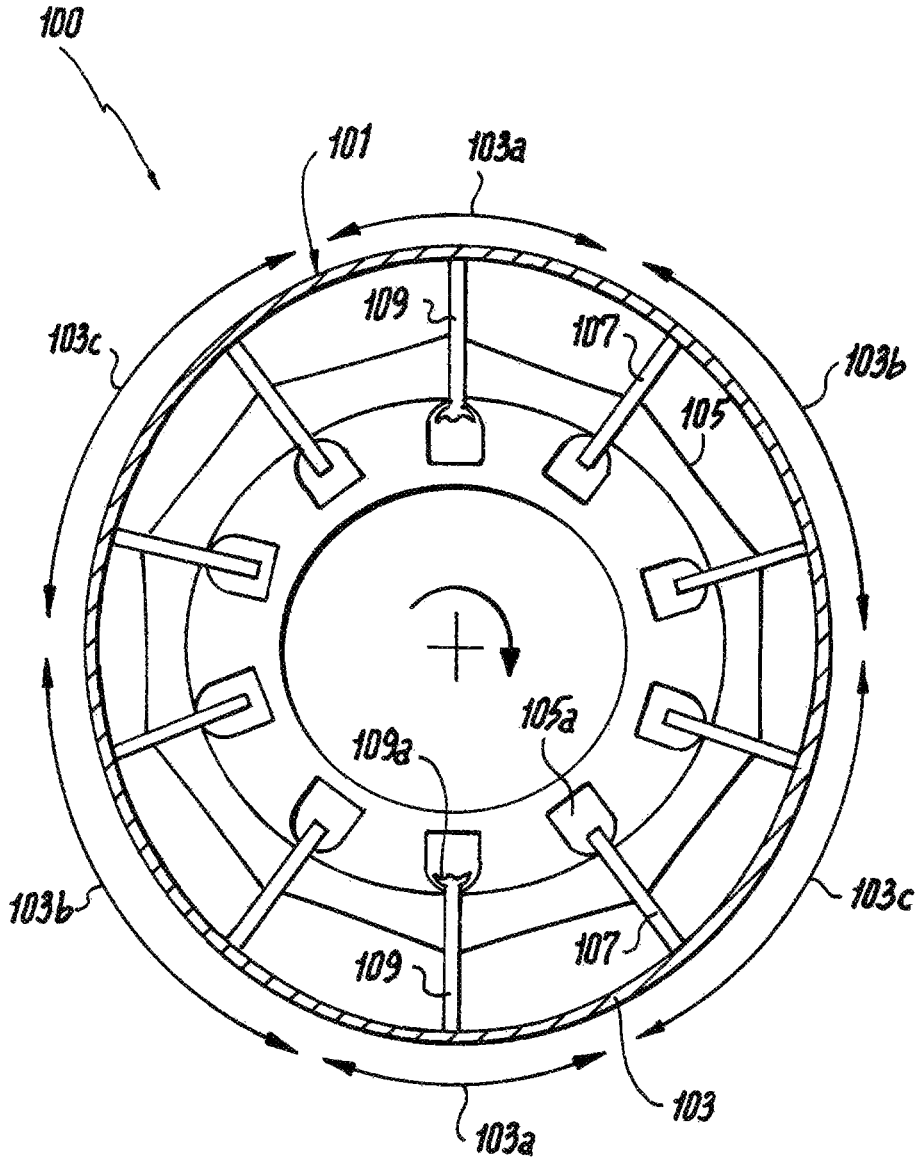
FIG. 1 is a cross-sectional elevation view of an embodiment of a vane pump in accordance with this disclosure, showing symmetrically disposed sentinel vanes.

Reference will now be made to the drawings wherein like reference numerals identify similar structural features or aspects of the subject disclosure. For purposes of explanation and illustration, and not limitation, an illustrative view of an embodiment of a vane pump in accordance with the disclosure is shown in FIG. 1 and is designated generally by reference character 100. Other embodiments and/or aspects of this disclosure are shown in FIGS. 2-5. The systems and methods described herein can be used to provide wear detection for vane pumps before pump failure.

Referring to FIG. 1, a vane pump 100 includes a liner 101 defining a cammed inner surface 103. As is appreciated by those skilled in the art, the cammed inner surface 103 defines a non-circular cross-section. For example, the liner 101 can include one or more constant radius portions 103*a*, one or more pumping sections 103*b* where the radius of the cammed inner surface 103 progressively diminishes, and one or more filling sections 103*c* where the radius of the cammed inner surface 103 progressively increases.

A rotor 105 is rotatably disposed within the liner 103. The rotor 105 has a plurality of vane slots (shown filled with vanes 107, 109).

Figure 2:
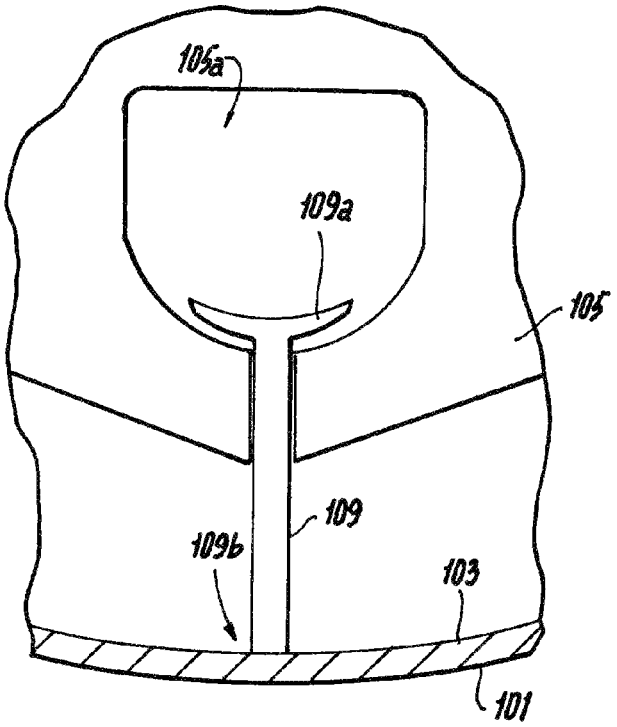
FIG. 2 is a partial cross-sectional view of an embodiment of a sentinel vane in accordance with this disclosure shown in a constant radius portion of the liner and in an unworn condition.
Figure 3:
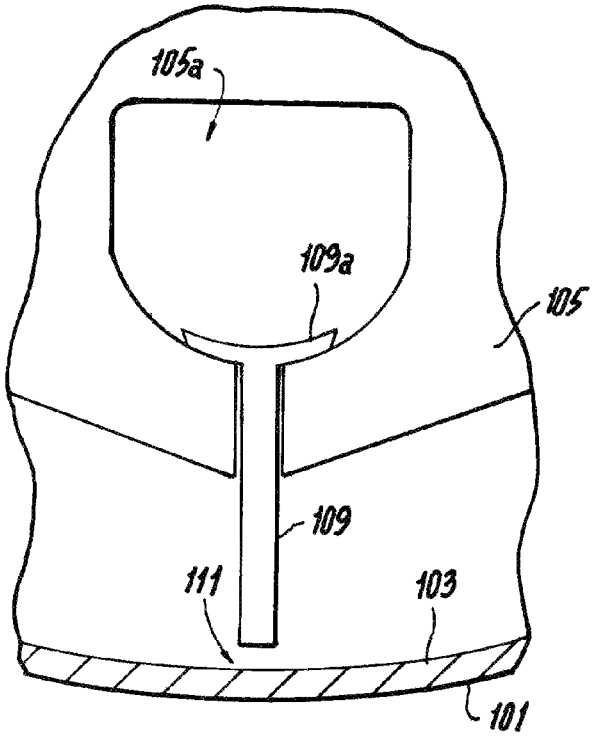
FIG. 3 is a partial cross-sectional view of an embodiment of a sentinel vane in accordance with this disclosure shown in a constant radius portion of the liner and in a worn condition.

Referring additionally to FIGS. 2 and 3, the vane pump 100 also includes a plurality of vanes 107, 109 slidably disposed within vane slots of the rotor 105. The vanes 107, 109 are configured to extend away from the rotor 105 and contact the cammed inner surface 103 of the liner 101. In certain embodiments, the vanes 107, 109 can be force outwardly via centrifugal force and/or via a pressure differential between the overvane cavity and undervane cavity to maintain contact with the cammed inner surface 103. In certain embodiments, the vanes 107, 109 can be biased radially outwardly, e.g., via a spring (not shown), to maintain contact with the cammed inner surface 103.

The plurality of vanes 107, 109 can include at least one sentinel vane 109 that are configured to allow detection of wear on the sentinel vane 109 (which can indicate a worn state over the vanes 107, 109 overall). Each sentinel vane 109 can include a base portion 109*a* that is larger than its respective vane slot of the rotor 105. The base portion can be shaped to have a corresponding contour of an undervane cavity surface 105*a*. For example, the base portion can be curved as shown. It is contemplated, however, that the base portion 109*a* can have any other suitable shape.

As shown between FIGS. 2 and 3, over time, each sentinel vane 109 will wear at the tips 109*b* along with other vanes 107 due to friction from rubbing against the inner cammed surface 103. After the sentinel vane 109 wears a predetermined amount, the base portion 109*a* prevents the sentinel vane 109 from extending further from the rotor 105 as shown in FIG. 3. This can create a gap 111 between a sentinel vane tip 109*b* and a portion of the cammed inner surface 103. For example, the portion of the cammed inner surface 103 where the gap 111 is created can include the constant radius section 103*a* (which can be the portion requiring the furthest extension from the rotor.

In certain embodiments, the vane pump 100 can include plurality of symmetrically located sentinel vanes 109. As shown, the plurality of symmetrically located sentinel vanes 109 can include two sentinel vanes 109 spaced 180 degrees circumferentially from each other. In certain embodiments, the plurality of symmetrically located sentinel vanes 109 can be spaced circumferentially apart 360/N degrees, wherein N is the total number of sentinel vanes 109. By spacing the sentinel vanes 109 symmetrically, forces created due to the gaps 111 can be balanced avoiding any potentially detrimental vibration, for example.

Figure 4:
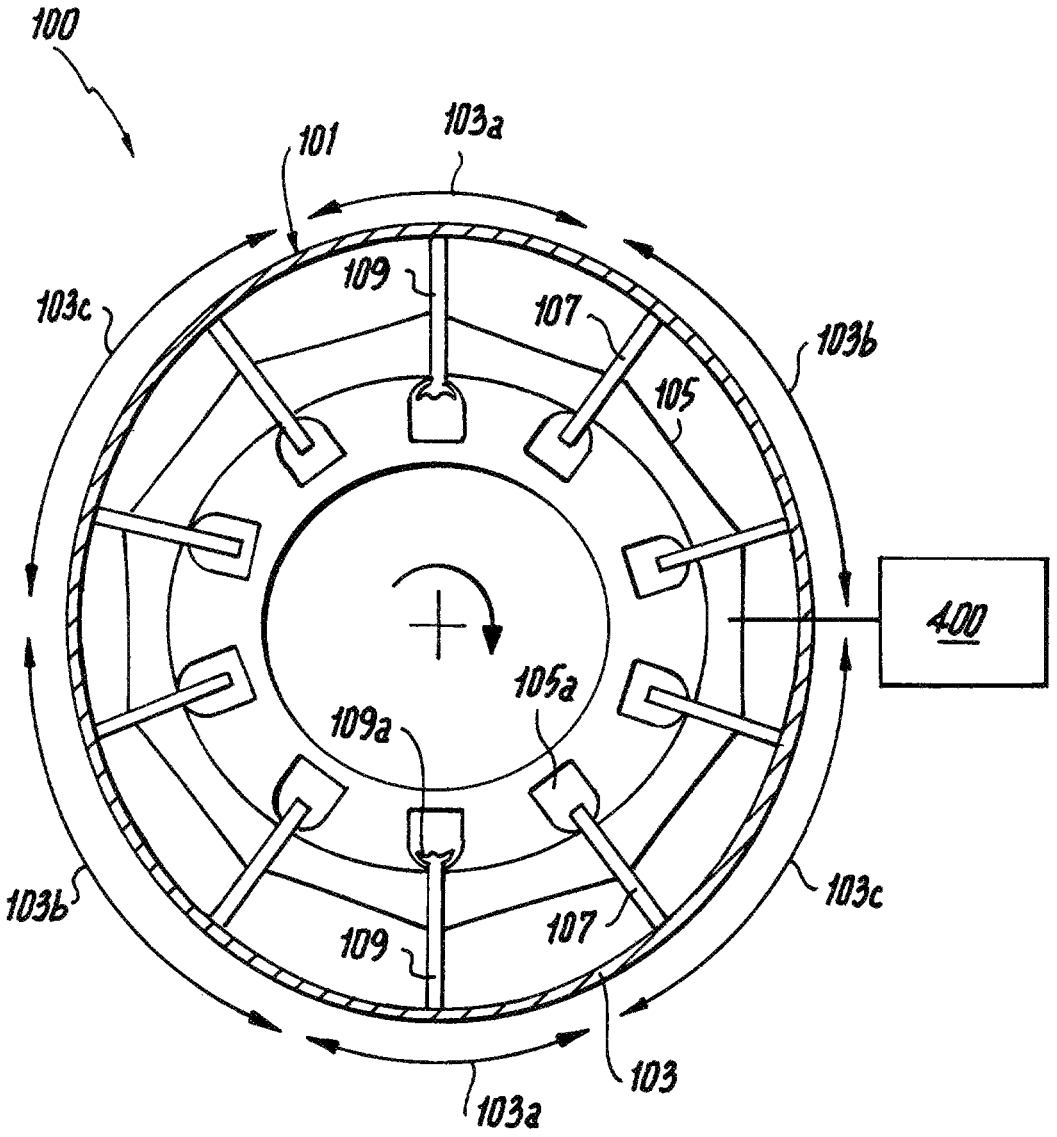
FIG. 4 is a cross-sectional elevation view of the vane pump of FIG. 1, shown connected to a vibration sensor.
Figure 5:
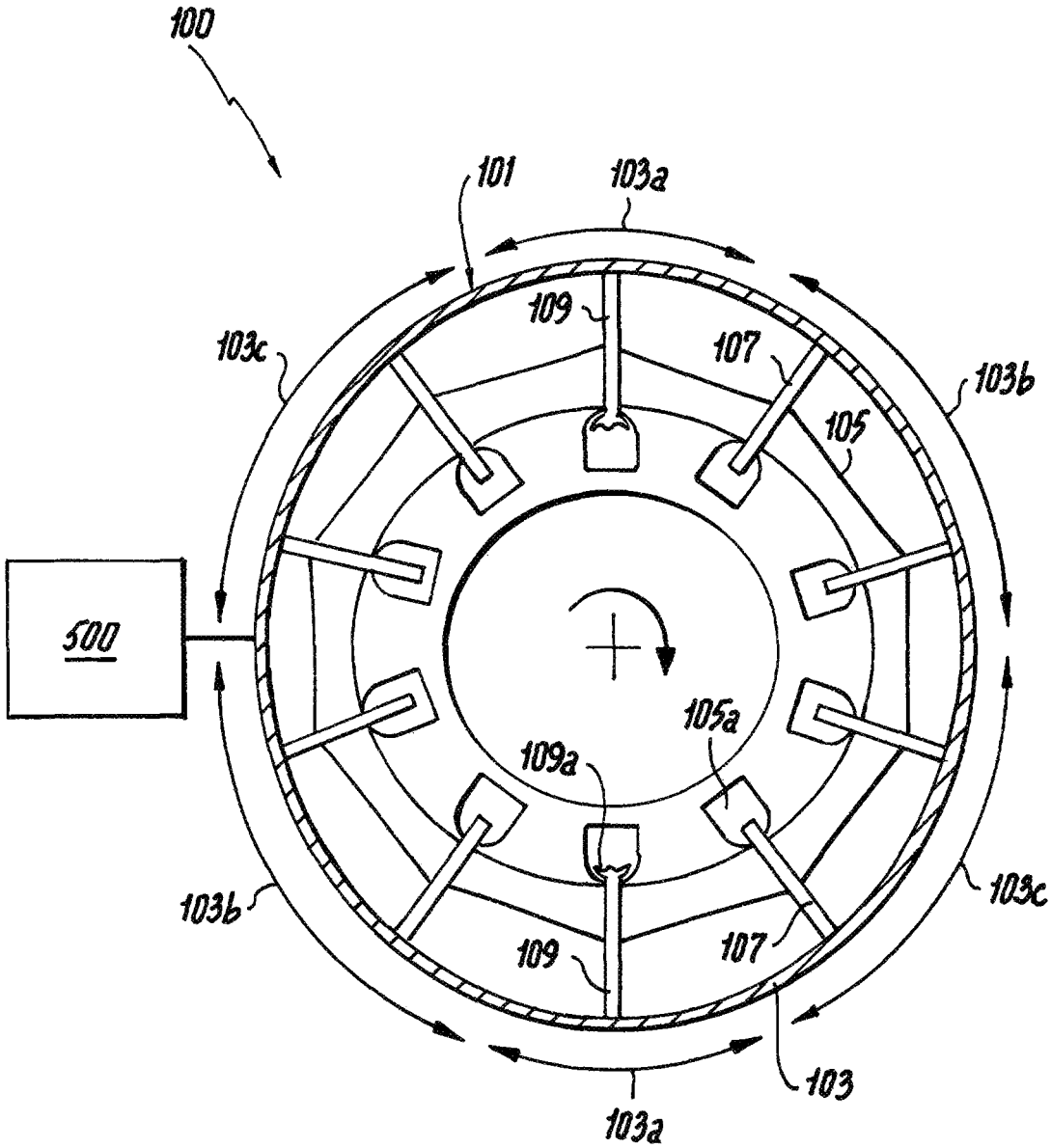
FIG. 5 is a cross-sectional elevation view of the vane pump of FIG. 1, shown connected to a sensor.

Referring to FIG. 4, the vane pump 100 can further include a vibration sensor 400 operatively connected to the rotor 105 to determine when the base portion 109*a* of sentinel vanes 109 contacts the rotor 105. Referring to FIG. 5, the vane pump 100 can include a sensor 500 operatively connected to the vane pump 100 to sense a pressure pulsation from flow through the gap 111 created between the sentinel van tip 109*b* and the liner 101. The sensor can additionally or alternatively be operatively connected to the vane pump 100 and/or at least one device (not shown) that is connected to the vane pump 100 to sense a pressure and/or flow loss due to the gap 111.

In accordance with at least one aspect of this disclosure, a method for detecting wear in a vane pump 100 can include allowing a gap 111 to form between a sentinel vane tip 109*b* and a liner 111 in at least one section of the liner as the sentinel vane 109 passes through the at least one section (e.g., constant radius section 103*a*). Allowing the gap 111 to form can include restraining a base portion 109*b* of the sentinel vane 109 within the rotor 105 by allowing the base portion 109*a* to contact the rotor 105 to prevent further outward movement of the sentinel vane 109.

The method can further include detecting a vibration due to the base portion 109*a* of the sentinel vane 109 contacting the rotor 105. In certain embodiments, the method can include detecting a pressure pulsation due to flow through the gap 111 between the sentinel vane tip 109*b* and the liner 111. The method can include determining a performance loss of the vane pump 100 due to the gap 111 between the sentinel vane tip 109*a* and the liner 111. The method can further comprising indicating that the vane pump 100 is in a worn condition (e.g., via a warning light, electronic display, message, or any other suitable indication).

Certain embodiments described above cause a leakage or blowby condition that can be detected either by loss of flow performance (e.g., possibly by observing a reduction in performance of components that are supplied flow from this pump) or a pressure perturbation or vibration signature of a specific frequency (e.g., a multiple of pump speed). For example, the resulting bottoming of the base portion 109*a* of the sentinel vanes 109 can produce a vibration signature that may manifest as a "1E" (i.e. one-per-revolution) or "2E" (two-per-revolution) depending on the wear pattern and part tolerances. This can be detected, e.g., by a vibration sensor mounted either on or in close proximity to the pump, rotor, and/or in concert with suitable filtering algorithms.

In certain cases, sentinel vane tip 109*b* leakage or blowby may manifest in flow performance loss that could be detected by the loss in performance of another component that uses flow from such a vane pump 100 or by manifestation of a system level anomaly (e.g., delayed starting light-off in a jet engine burn flow application). Such conditions may require a built-in-test (BIT) or manual test in which the pump and its powered components are tested in a challenging condition that only pass if the pump was functioning normally.

It is also contemplated that sentinel vane tip 109*b* leakage may also manifest in pressure pulsations at 1E frequency or multiples thereof that can be measured by, e.g., a high-response pressure transducer and/or suitable software algorithms.

The methods and systems of the present disclosure, as described above and shown in the drawings, provide for vane pumps with superior properties including wear detection. While the apparatus and methods of the subject disclosure have been shown and described with reference to embodiments, those skilled in the art will readily appreciate that changes and/or modifications may be made thereto without departing from the spirit and scope of the subject disclosure.

What is claimed is:

1. A vane pump, comprising:

a liner defining a cammed inner surface;

a rotor rotatably disposed within the liner and including a plurality of vane slots;

a plurality of vanes slidably disposed within vane slots of the rotor and configured to extend away from the rotor and contact the cammed inner surface of the liner, wherein the plurality of vanes include at least one sentinel vane that is configured to allow detection of wear on the sentinel vane;

wherein the sentinel vane includes a base portion that is larger than the vane slot of the rotor such that after the sentinel vane wears a predetermined amount, the base portion prevents the sentinel vane from extending further from the rotor such that a gap separates a sentinel vane tip and a portion of the cammed inner surface; and a vibration sensor operatively connected to the rotor to determine when the base portion of the at least one sentinel vane contacts the rotor.

2. The vane pump of claim 1, wherein the portion of the cammed inner surface where the gap is created includes a constant radius section.

3. The vane pump of claim 1, wherein the at least one sentinel vane includes a plurality of symmetrically located sentinel vanes.

4. The vane pump of claim 3, wherein the plurality of symmetrically located sentinel vanes includes two sentinel vanes spaced 180 degrees circumferentially from each other.

5. The vane pump of claim 3, wherein the plurality of symmetrically located sentinel vanes are spaced circumferentially apart 360/N degrees, wherein N is the total number of sentinel vanes.

6. The vane pump of claim 1, wherein the base portion is shaped to have a corresponding contour of an undervane cavity surface.

7. The vane pump of claim 6, wherein the base portion is curved.

8. A method for detecting wear in a vane pump, comprising:

allowing a gap to form between a sentinel vane tip and a liner in at least one section of the liner as the sentinel vane passes through the at least one section;

wherein allowing the gap to form includes restraining a base portion of the sentinel vane within a rotor by allowing the base portion to contact the rotor to prevent further outward movement of the sentinel vane; and detecting a vibration due to the base portion of the sentinel vane contacting the rotor.

9. The method of claim 8, further comprising determining a performance loss of the vane pump due to the gap between the sentinel vane tip and the liner.

10. The method of claim 8, further comprising indicating that the vane pump is in a worn condition.

11. A method for detecting wear in a vane pump, comprising:

providing a plurality of vanes including at least one first vane and at least one sentinel vane, wherein the at least one sentinel vane is different in shape than the at least one first vane;

allowing a gap to form between a sentinel vane tip and a liner in at least one section of the liner as the at least one sentinel vane passes through the at least one section;

wherein allowing the gap to form includes restraining a base portion of the at least one sentinel vane within a rotor by allowing the base portion to contact the rotor to prevent further outward movement of the at least one sentinel vane; and detecting a pressure pulsation due to flow through the gap between the sentinel vane tip and the liner.

* * * * *